United States Patent [19]

Nino

[11] Patent Number: 4,916,585

[45] Date of Patent: Apr. 10, 1990

[54] HEADLIGHT DEVICE FOR VEHICLE

[75] Inventor: Naohi Nino, Shizuoka, Japan

[73] Assignee: Koito Seisakusho Co., Ltd., Shizuoka, Japan

[21] Appl. No.: 331,981

[22] Filed: Apr. 3, 1989

[30] Foreign Application Priority Data

Apr. 4, 1988 [JP] Japan ..... 63-82759

[51] Int. Cl.[4] ..... F21V 7/00

[52] U.S. Cl. ..... 362/61; 362/297; 362/346

[58] Field of Search ..... 362/61, 297, 346, 347, 362/348

[56] References Cited

U.S. PATENT DOCUMENTS

| | | | |
|---|---|---|---|
| 1,691,131 | 11/1928 | Ryder | 362/348 |
| 3,986,017 | 10/1976 | Kulle | 362/216 |
| 4,100,594 | 7/1978 | Gould | 362/308 |
| 4,149,227 | 4/1979 | Dorman | 362/348 |
| 4,511,955 | 4/1985 | Ernst et al. | 362/347 |
| 4,517,630 | 5/1985 | Dieffenbach et al. | 362/339 |
| 4,669,032 | 5/1987 | Lietar et al. | 367/61 |
| 4,697,225 | 9/1987 | Lindae et al. | 362/297 |
| 4,772,987 | 9/1988 | Kretschmer et al. | 362/297 |
| 4,779,179 | 10/1988 | Oyama et al. | 362/348 |

FOREIGN PATENT DOCUMENTS 3406876 2/1984 Fed. Rep. of Germany .

*Primary Examiner*—Ira S. Lazarus
*Assistant Examiner*—Richard R. Cole
*Attorney, Agent, or Firm*—Sughrue, Mion, Zinn, Macpeak & Seas

[57] ABSTRACT

A headlight device comprising a reflective mirror having a reflective zone consisting of a plurality of reflective elements, and a light source arranged along an axis of irradiation which extends in the fore and aft direction of the reflective mirror. The reflective elements constituting the reflective zone are formed to have parabola-ellipse composite surfaces. The composite surface is defined to have a parabola in the vertical section and an ellipse in the horizontal section.

5 Claims, 11 Drawing Sheets

HEADLIGHT DEVICE FOR VEHICLE

FIELD OF THE INVENTION

The present invention relates to a headlight device for a vehicle such as an automobile and the like and, particularly to a noval headlight device adapted for that having a reduced dimension in the vertical directions and that being inclined in the upper and rear directions.

DESCRIPTION OF PRIOR ART

Various headlights have been proposed and utilized, and recently, according to the design of the automobile, the height or the vertical dimension of the headlight is reduced in some cases, and/or the lens of the headlight is excessively inclined in the upper and rear directions.

When the vertical dimension of the lens is reduced, it is difficult to maintain the amount of the light passing through the lens in the vertical directions, and to control the light beam in the vertical direction, thus, it is difficult to obtain desired light distribution.

Further, when the lens is inclined, the light passing through the lens is adversely effected thereby, thus, the headlight should have the characteristics for compensating the inclination of the lens.

FIG. 10 through FIG. 12 show a prior art headlight device a preventing the decrease in the effective amount of the light due to the inclination of the lens and having a reflective mirror b which has the desired light distribution characteristics.

The reflective surface of the mirror b consists of a plurality of reflective elements c, c, . . . of parabolic pillar like configuration. Each reflective element c (referred hereinafter as segment) is, as shown in FIG. 11, defined as a portion of the surface g of a parabolic pillar which circumscribes with an imaginary paraboloid of revolution d (having the focus F) at the intersecting line f between the imaginary paraboloid d and a basic surface e which is parallel to the axis of rotation r-r of the imaginary paraboloid d. A segment c′ adjoining the segment c is defined by a paraboloid of revolution d′ having the focus F′, a basic surface f′, an intersecting line f′ between the paraboloid d′ and the basic surface f′ and the parabolic pillar surface g′ as shown in FIG. 11. Remaining segments can be defined by similar procedure.

In FIG. 11, when a light source is positioned at the focus F, the light distribution of the light emitted from the focus F and reflected on the basic surface e makes a horizontally extending pattern h shown in FIG. 12 which is integrated into a light distribution pattern of the headlight a. Shown at H—H in FIG. 12 is the horizontal axis, and at V—V in FIG. 12 is a vertical line.

The headlight a is defective in that the angle of the light spread of the reflective surface is limited by the horizontal length L of each segment. Accordingly, for increasing the angle of the light spread it is required to increase the horizontal length L of each segment which increases the overall horizontal length of the headlight thereby limiting the freedon in the design or to provide a lens having a plurality of step portions which substantially increases the cost of the lens.

SUMMARY OF THE INVENTION

An object of the invention is to solve the problems above mentioned and, according to the invention, there is provided a headlight device of the type including a reflective mirror having a reflective zone consisting of a plurality of reflective elements and a light source arranged along an axis of irradiation which extends in the fore and aft direction of the reflective mirror. The reflective elements constituting the reflective zone are formed of parabola-ellipse composite surfaces.

Thus, according to the invention, the angle of the light spread is not determined solely by the horizontal length of the reflective element and can be determined as desired by setting suitably the parameters for determining the configuration of the parabola-ellipse composite surface. And it is possible to obtain a desired pattern of light distribution without providing stepped portions having a large angle of spread on the lens.

BRIEF DESCRIPTION OF THE DRAWINGS

Further objects and advantages of the invention will become apparent from the following detailed description in conjunction with accompanying drawings, in which:

FIG. 1 through FIG. 8 show a headlight device according to a first embodiment of the invention;

FIG. 1 is a exploded perspective view of the essential portion of the headlight device;

FIG. 2 is a horizontal sectional view of FIG. 1;

FIG. 3 is a front view with the lens being removed;

FIG. 5 is a schematic view showing the design procedure of the reflective segments;

FIG. 6 is a view showing a light distribution pattern;

FIG. 7 is a horizontal sectional view of the essential portion of a modified form;

FIG. 8 is a schematic view showing the arrangement of reflective segments;

FIG. 9 is a front view with the lens being removed;

FIG. 11 is a view for explaining the configuration of a segment, and

FIG. 12 is a view showing a light distribution pattern.

DETAILED DESCRIPTION OF PREFERRED EMBODIMENTS

Figure 1:
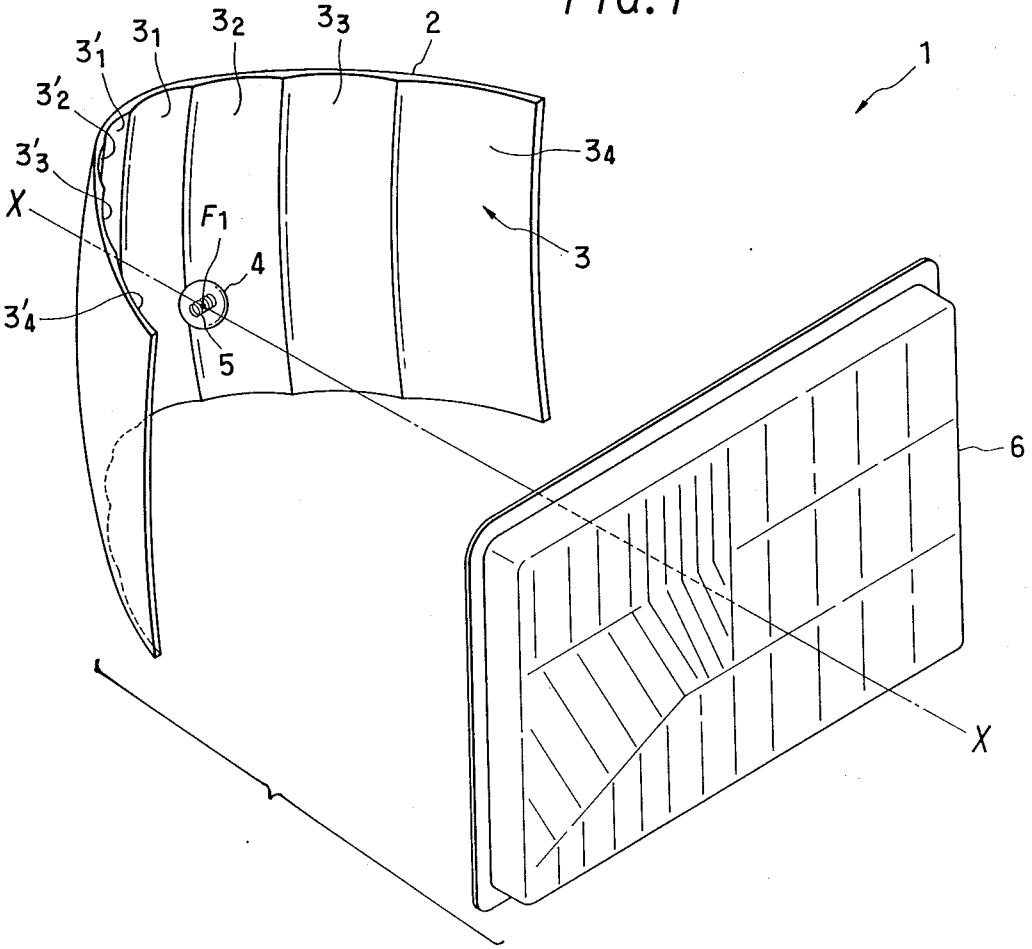
Figure 2:
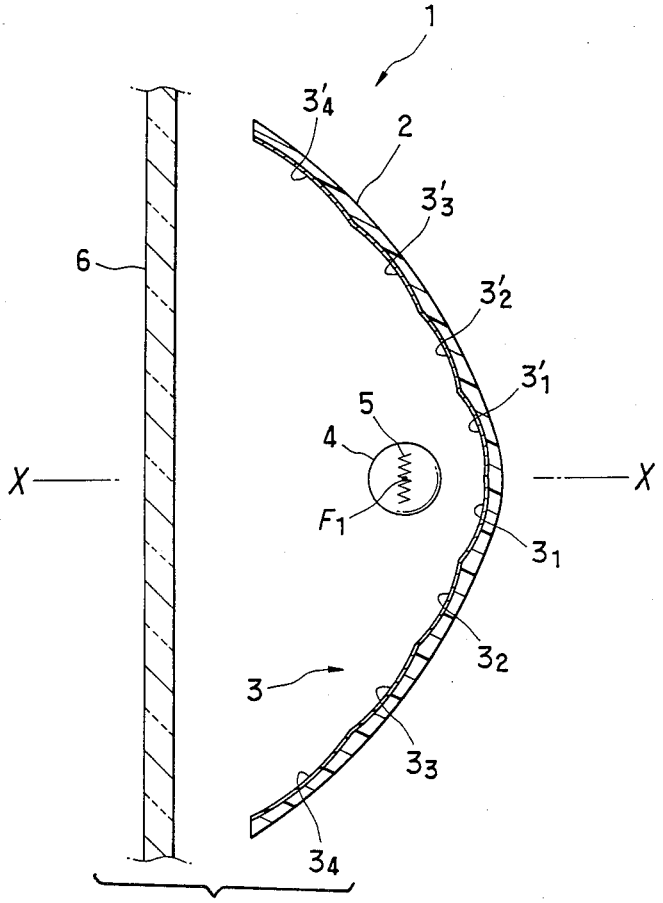

First Embodiment (FIG. 1 through FIG. 8)

The headlight device shown in FIG. 1 through FIG. 8 comprises a reflective mirror 2 having a reflective surface 3 which consists of a plurality of segments $3_1$, $3_2$, $3_3$, . . . and $3'_1$, $3'_2$, $3'_3$ . . . . Each segment is of the configuration of a portion of a parabola-ellipse composite surface, and of a generally vertically extending rectangular shape. The wording "parabola-ellipse composite surface" in the specification is defined as the surface having the form of a parabola in the vertical section, and the form of an ellipse in the horizontal section, with the focus of the parabola being at the first focus of the ellipse. The surface does not include an elliptic parabola surface.

Shown at numeral 4 in the drawings is an electric bulb located on an illuminating axis X—X which extends in the fore and aft direction of the headlight device. The bulb 4 has a filament 5. And the center of the filament 5 is located on the common focus $F_1$ of the segments $3_1$, $3_2$, $3_3$, . . . and $3'_1$, $3'_2$, $3'_3$ . . . . The reflective mirror 2 is received in a lamp body (not shown) and the front surface of the lamp body is covered by a lens 6. The lens 6 is formed to have various steps according to common practice having the function of scattering and the like.

Reflective Surface 3 (FIG. 1 through FIG. 5)

Now, description will be made for obtaining the equation representing the segments constituting the reflective surface 3 of the reflective mirror 2 and the procedure for forming the reflective surface 3 from these segments.

Figure 4A:
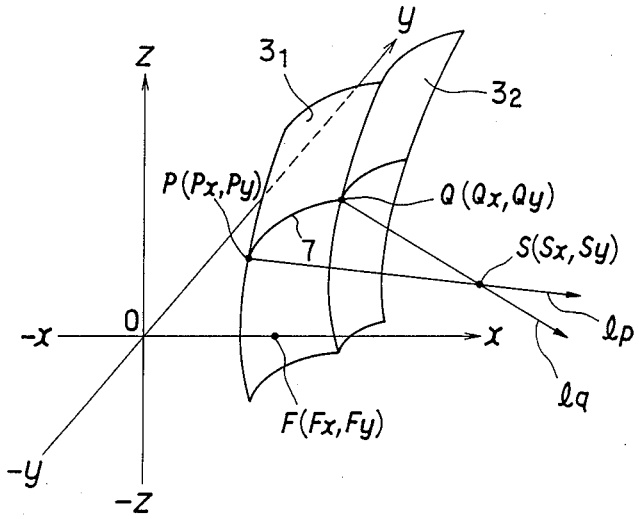
FIG. 4(A) is a schematic perspective view for showing the setting of the coordinates.
Figure 4B:
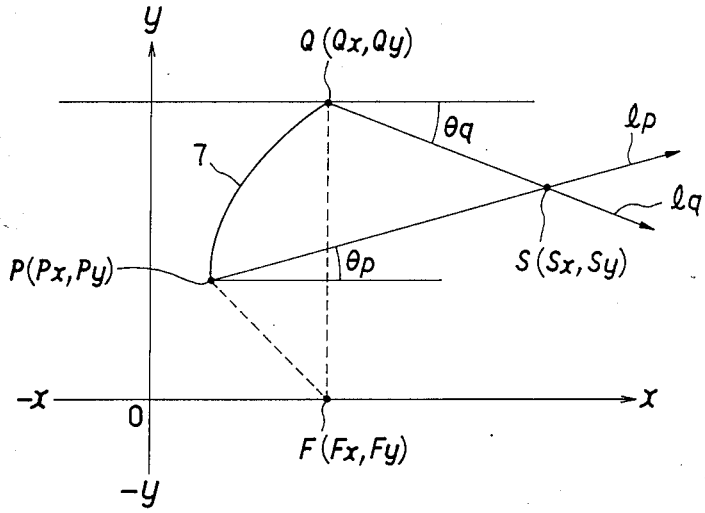
FIG. 4(B) is a schematic plan view of FIG. 4(A)
Figure 4C:
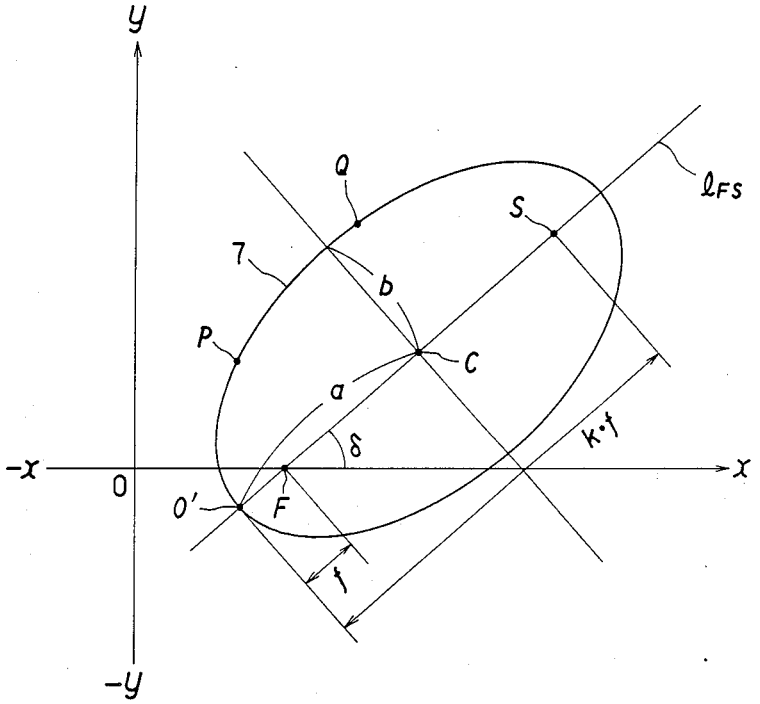
FIG. 4(C) is a schematic view of an ellipse.

In FIG. 4(A)~4(C), x-axis is an axis coinciding the illuminating axis X—X, y-axis is a horizontal axis and z-axis is a vertical axis. In the drawing, the point F ($F_x$, $F_y$) is an imaginary point source of light, the point P ($P_x$, $P_y$) is a point on a line of intersection 7 between the segment $3_1$ and x-y plane and being nearest to the point F, and the point Q ($Q_x$, $Q_y$) is the most far from the point F. The light emitted from the point F is reflected at the point P. The reflected light $1_p$ defines a scattering angle $\theta_p$ with respect to a line parallel to the x—x axis as shown in FIG. 4(B), similarly, the light reflected at the point Q defines a scattering angle $\theta_q$. The angle $\theta_p$ has the plus sign and the angle $\theta_q$ has the minus sign. It will be noted that the z-ordinates of these points are zero, and that the line of intersection 7 or the line PQ is a portion of an ellipse.

The equation representing the ellipse can be determined from seven parameters of the eight parameters $F_x$, $F_y$ $P_x$, $P_y$ $Q_x$, $Q_y$ $\theta_p$ and $\theta_q$, thus, it is assumed that the parameter $Q_x$ is unknown, and the procedure for determining the ellipse from remaining seven parameters.

Firstly, the intersection S ($S_x$, $S_y$) between the line $1_p$ which passes through the point P and inclines to x—x axis by the angle $\theta_p$ and the line $1_q$ which passes through the point Q and inclines to x—x axis by the angle $\theta_q$ is determined. The lines $1_p$ and $1_q$ are determined as follows:

$$\text{line } 1_p\text{: } y=\tan\theta_p\cdot(x-P_x)+P_y$$

$$\text{line } 1_q\text{: } y=\tan\theta_q\cdot(x-Q_x)+Q_y$$

From these two equations, the point S can be obtained:

$$S_x(Q_x)=[Q_y-P_y+\tan\theta_p\cdot P_x-\tan\theta_q\cdot Q_x]/(\tan\theta_p-\tan\theta_q) \quad (1)$$

$$S_y(Q_y)=\tan\theta_p\cdot(S_x-P_x)+P_y \quad (2)$$

Incidentally, $S_x(Q_x)$ and $S_y$ $(Q_y)$ indicate that the ordinate of the intersection S depends on $Q_x$ and $Q_y$.

Among the ellipses having the focii on the points S and F, the ellipse passing the points P and Q shall satisfy the equation:

$$\overline{FQ}+\overline{QS}=\overline{FP}+PS$$

$$K(Q_x)=\overline{FQ}+\overline{QS}-(\overline{FP}+\overline{PS})= \quad (3)$$

$$[(F_x-Q_x)^2+(F_y-Q_y)^2]^{\frac{1}{2}}+[(Q_x-S_x)^2+(Q_y-S_y)^2]^{\frac{1}{2}}-[(F_x-P_x)^2+(F_y-P_y)^2]^{\frac{1}{2}}-[(P_x-S_x)^2+(P_y-S_y)^2]^{\frac{1}{2}}=0$$

By solving the equation (3) it is possible to obtain $Q_x$, and from the equations (1) and (2), the point S can be determined.

Any point X (x, y, z) on the ellipse can be determined as follows:

$$\overline{FX}+\overline{XS}=\overline{FP}+\overline{PS}=\text{constant}=(L_{en})$$

$$G(x,y)=\overline{FX}+\overline{XS}-L_{en}= \quad (4)$$

$$[(x-F_x)^2+(y-F_y)^2]^{\frac{1}{2}}+[(x-S_x)^2+(y-S_y)^2]^{\frac{1}{2}}-L_{en}=0$$

$$L_{en}=\overline{FP}+\overline{PS}= \quad (5)$$

$$[(F_x-P_x)^2+(F_y-P_y)^2]^{\frac{1}{2}}+[(P_x-S_x)^2+(P_y-S_y)^2]^{\frac{1}{2}}$$

The center C ($C_x$, $C_y$) of the ellipse, the major axis a and the minor axis b are obtained as follows:

$$C(c_x, c_y)=[(F_x+S_x)/2,(F_y+S_y)/2]$$

$$a=(\overline{FP}+\overline{PS})/2=L_{en}/2$$

$$\begin{aligned} b &= [a^2-\overline{FC}^2]^{\frac{1}{2}} \\ &= [L_{en}^2/4-\{F_x-(F_x+S_x)/2\}^2-\{F_y-(F_y+S_y)/2\}^2]^{\frac{1}{2}} \\ &= (\tfrac{1}{2})\cdot[L_{en}^2-(F_x-S_x)^2-(F_y-S_y)^2]^{\frac{1}{2}} \end{aligned}$$

The segment is, according to the present invention, formed as a part of a parabola-ellipse composite surface and, the parameters for specifying the configuration of the composite surface and the direction of the optical axis can be obtained from the above equations.

Namely, as shown in FIG. 4(C) in defining a point O' as an intersection between a straight line $1_{FS}$ passing the focii F and S and the ellipse and being near to the focus F, then the distances f(=$\overline{O'F}$) and k·f(=$\overline{O'S}$) are:

$$f=(2a-\overline{FS})/2=a-(\overline{FS})/2 \quad (7)$$

$$k\cdot f=2a-f=2a-[a-(\overline{FS})/2]=a+(\overline{FS})/2 \quad (8)$$

wherein, $\overline{FS}=[(F_x-S_x)^2+(F_y-S_y)^2]^{\frac{1}{2}}$ (8)

wherein, $FS=[(F_x-S_x)^2+(F_y-S_6)^2]^{\frac{1}{2}}$

By defining δ is the angle between the line $1_{FS}$ and x-axis:

$$\tan\delta=(S_y-F_y)/(S_x-F_x)$$

thus, $$\delta=\tan^{-1}(S_y-F_y)/(S_x-F_x \quad (9)$$

Figure 5:
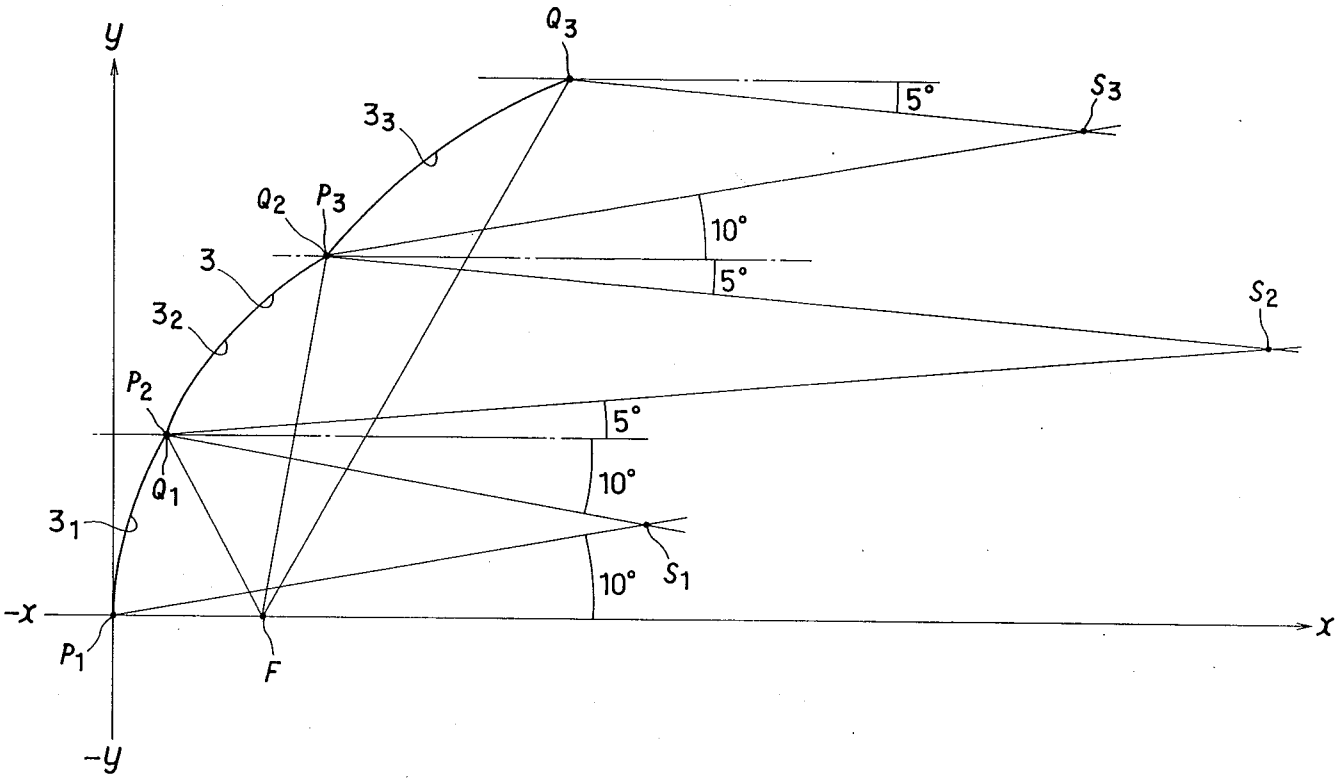

Configuration of Segment (FIG. 5)

The configuration of the parabola-ellipse composite surface can be determined from the equations (7) and (8) and, the direction of the optical axis of the segment can be determined from δ which is shown in equation (9).

When the optical axis of the segment is parallel to the x-axis, and the vertical direction is parallel to the y-axis, the composite surface is, by putting the distance from the apex to the first focus as f' and the distance from the apex to the second focus as k'·f'

$$[(x-f')^2+y^2+z^2]^{\frac{1}{2}}+[(x-k'\cdot f')^2+y^2]^{\frac{1}{2}}-(k'+1)\cdot f'=0 \quad (10)$$

Thus, from the equations (7), (8) and (10) and, by rotating the drawing around the axis passing the point F and through the angle δ, namely, by putting the ordinate after rotation as ($x^t$, $y^t$, $z^t$), $$\begin{pmatrix} x \\ y \\ z \end{pmatrix} = \begin{pmatrix} \cos\delta & \sin\delta & 0 \\ -\sin\delta & \cos\delta & 0 \\ 0 & 0 & 1 \end{pmatrix} \begin{pmatrix} x^t - f \\ y^t \\ z^t \end{pmatrix} + \begin{pmatrix} f \\ 0 \\ 0 \end{pmatrix} \quad (11)$$

By mathematically transposing from (x, y, z) to ($x^t$, $y^t$, $z^t$) according to the equation (11), it is possible to obtain the desired parabola-ellipse composite surface. The segment $3_1$ is defined such that the opposite ends are on the points P and Q.

It will be understood that the length of the composite surface in the vertical direction or in z-axis direction may be determined as desired.

The segment $3_2$ is determined by putting the point $Q(Q_x, Q_y)$ to correspond with the point $P(P_x, P_y)$ and obtaining $Q'_x$ of another end point $Q'(Q'_x, Q'_y)$ through similar procedure. (Other parameters are known).

Similarly, the configuration of segments 33, 34, . . . can be determined.

In short, the procedure consists of:

(a) setting parameters;

(b) obtaining the ellipse by assuming one ($Q_x$ in the example) of the parameters is unknown;

(c) obtaining parameters defining the configuration of the ellipse and, also, parameters defining the direction of the optical axis of the segmemnt;

(d) determining the parabola-ellipse composite surface from the parameters obtained bu the step (c), with a part of which defining the configuration of the segment, and (e) determining the configuration of respective segments by repeating the steps (a)~(d) sequentially.

FIG. 5 shows one example of the procedure. The focus F is assumed as F(25.0, 0) [hereinafter, the unit mm is omitted, thus, F(25.0, 0) means F(25.0 mm, 0 mm)]. The drawing shows the intersection between respective segments and the x-y plane (portions of ellipse respectively), with the first segment $3_1$ being $P_1$ (0.0, 0.0), $Q_1$(8.9, 30.0), $\theta_P = 10°$, and $\theta_q = -10°$; the second segment $3_2$ being $P_2$ (B 8.9, 30.0), $Q_2$(35.7, 60.0), $\theta_P = 5°$, and $\theta_q = -5°$, and the third segment $3_3$ being $P_3$ (35.7, 60.0), $Q_3$(77.1, 90.0), $\theta_P = 10°$, and $\theta_q = -5°$. In the drawing shown at $S_1$, $S_2$ and $S_3$ are the second focii of respective ellipses.

Figure 6:
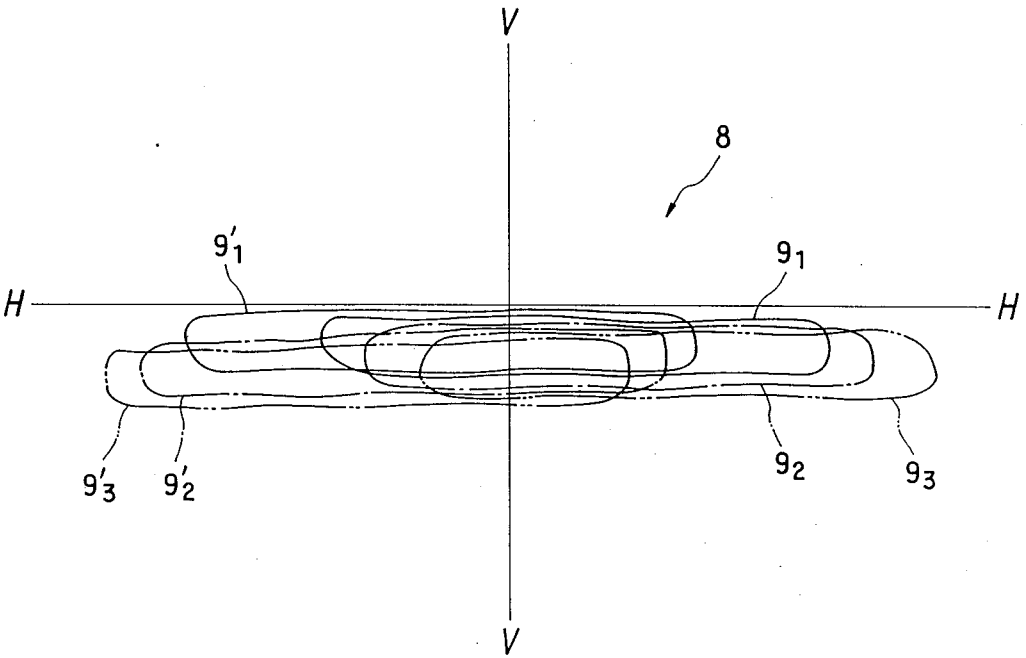

Light Distribution Pattern (FIG. 6)

The reflective mirror 2 makes a light distribution pattern 8 as shown in FIG. 6.

Shown at $9_1$ through $9_3$ are respective patterns formed of respective segments $3_1$ through $3_3$. The light emitted from the bulb 4 located on the common focus F is reflected at respective segments $3_1$ through $3_3$ so as to converge at respective second focii $S_1$ through $S_3$, thus, the pattern is expanded in the left and right directions.

Figure 3:
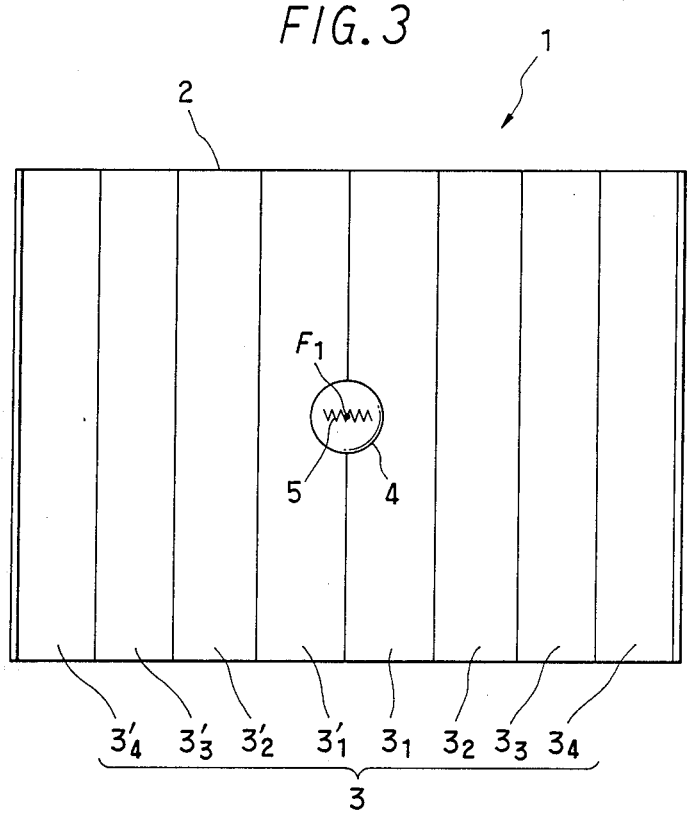

Shown at $9'_1$ through $9'_3$ are respective pattern formed of respective segments $3'_1$ through $3'_3$ which are shown also in FIG. 3.

Accordingly, by composing respective light distribution pattern of respective segments, it is possible to obtain that of the reflective mirror 2 and, the reflected light is expanded in the transverse direction.

The angle of scattering or dispersion $\theta_P$ and $\theta_Q$ of each segment can be determined as desired.

Figure 8:
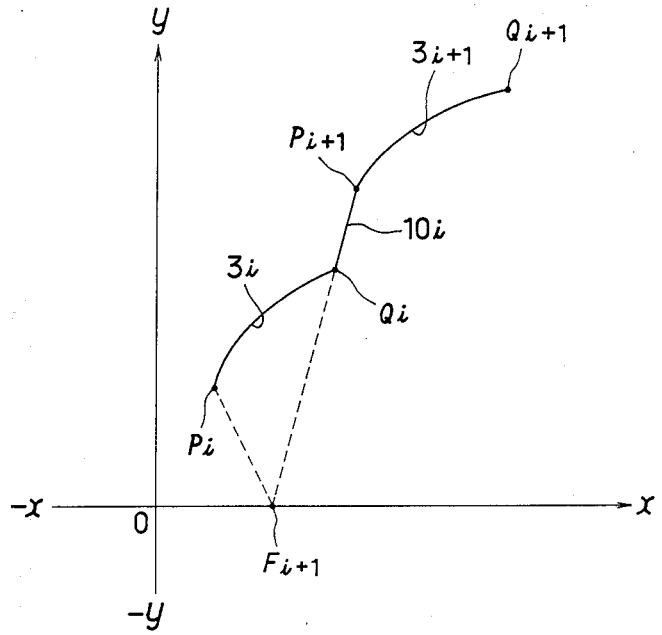
Figure 7:
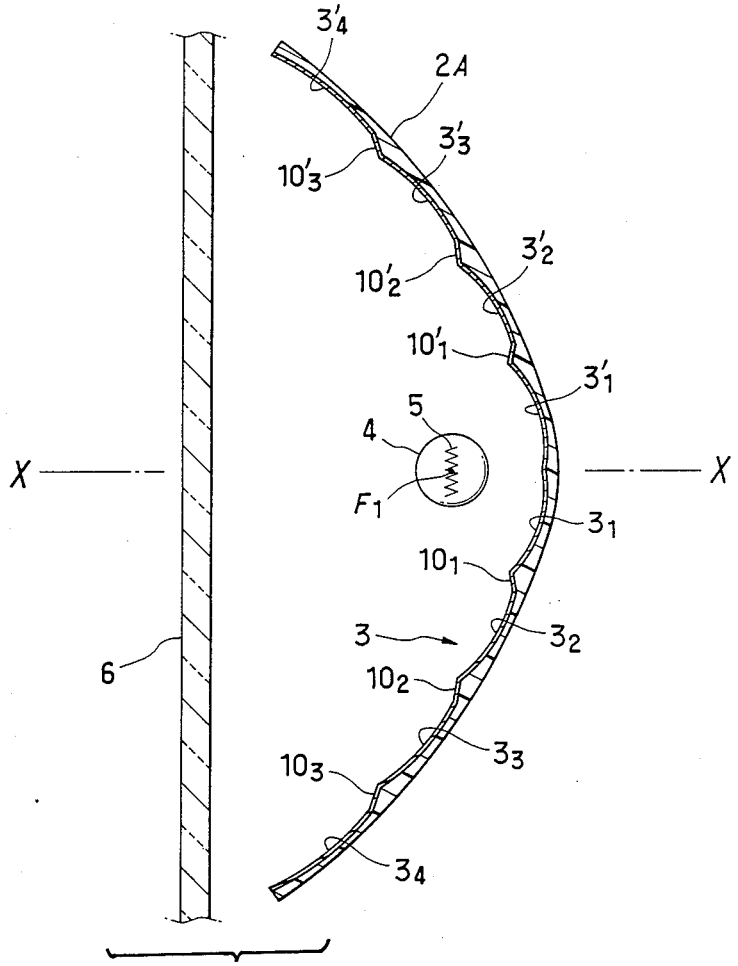

Modified Form (FIG. 7 and FIG. 8)

FIG. 7 shows a modified reflective mirror 2A which differs slightly from the mirror 2 in the arrangement of the segments. There are formed between adjoining segments stepped portions $10_1$, $10_2$, $10_3$, . . . and stepped portions $10'_1$, $10'_2$, $10'_3$ between respective segments. In the embodiment, the focii of respective segments are located at different locations.

The reflective mirror 2A having the stepped portions $10_1$, $10_2$, $10_3$, . . . is formed as follows:

As shown in FIG. 8, assuming that $F_i$ (i=1, 2, 3, . . . ) is the imaginary focus of the segment $3_i$ and that the opposite end points of the intersection between the segment $3_i$ and the x-y plane are $P_i$ and $Q_i$, the succeeding segment $3_{i+1}$ can be determined by locating the point $P_{i+1}$ on the extension line connecting the focus $F_{i+1}$ and the point $Q_i$ and, the point $Q_{1+1}$ and can be determined by the procedure described above with reference to FIG. 5.

The embodiment is advantageous in that the projected portions on the boundary of respective segments can effectively prevent the formation of the shadow, thus preventing the loss of the light.

Figure 9:
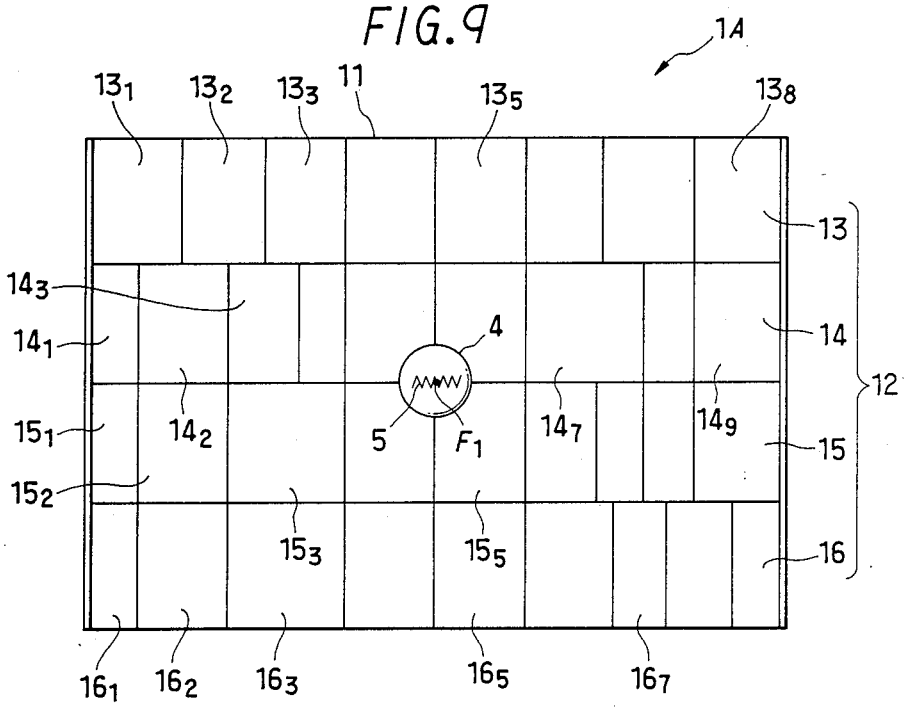
FIG. 9 is a front view of a headlight device according to a second embodiment of the present invention.
Figure 10:
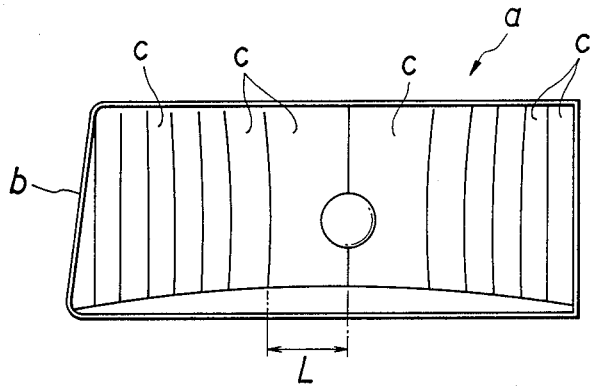
FIG. 10 PRIOR ART
FIG. 10~FIG. 12 shows a prior art headlight device.
Figure 11:
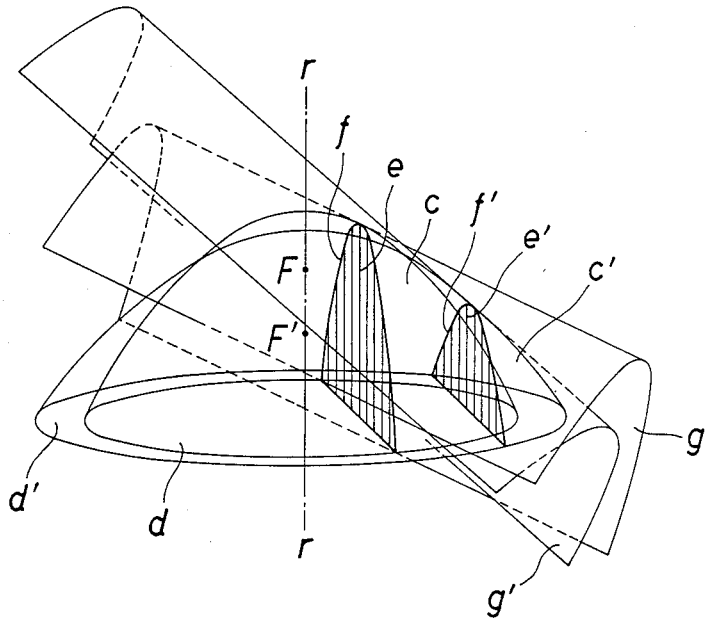
FIG. 11 PRIOR ART
Figure 12:
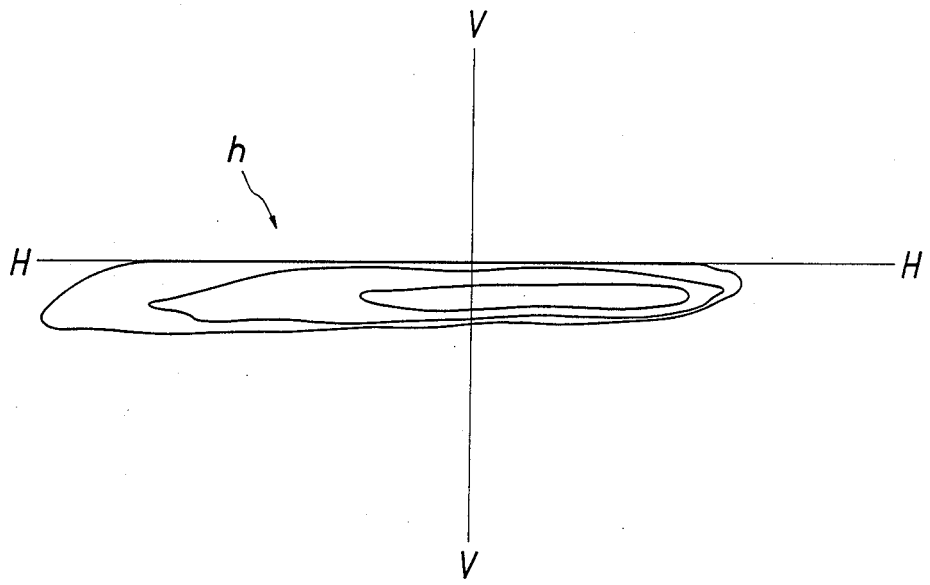
FIG. 12 PRIOR ART

Second Embodiment (FIG. 9)

FIG. 9 shows the second embodiment of the present invention, wherein the reflective surface is further divided in the vertical direction.

In the headlight device 1A shown in FIG. 9, the same reference numerals are applied to parts corresponding to the first embodiment and detailed description therefor is omitted.

Shown at numeral 11 is a reflective mirror, and the reflective surface 12 of which consists of four reflective zones 13, 14, 15 and 16 and, each reflective zone is constituted of a plurality of segments $13_i$, $14_i$, $15_i$ and $16_i$, wherein $i = 1, 2, 3, \ldots$.

Each segment $13_i$, $14_i$, $15_i$ or $16_i$ has the configuration of parabola-ellipse composite surface.

The second embodiment enables the attainment of a closely designed light distribution pattern by increasing the number of reflective zones.

As described heretofore, the headlight device for a vehicle according to the invention comprises a reflective mirror having a reflective zone consisting of a plurality of reflective elements and a light source arranged along an axis of irradiation which extends in the fore and aft direction of the reflective mirror. And the reflective elements constituting the reflective zone are formed of parabola-ellipse composite surfaces. Thus, according to the invention, the light distribution pattern, particularly the extension of the pattern in the transverse direction is not restricted by the size of the reflective mirror in the transverse direction or the width of the headlight device. Further, the function of the lens for forming the desired light distribution pattern can be alleviated, and the design of the lens is easy.

In the embodiments, the entire reflective surface of the reflective mirror is divided into a plurality of reflective elements, but the invention is not limited to the embodiments. For example, when the headlight device includes a reflective surface being divided into upper, lower, left and right reflective zones, the upper and lower reflective zones may be formed of simple reflective surfaces, and the left and right reflective zones may be constituted of a plurality of reflective elements according to the invention.

In the embodiments, the reflective elements are arranged along either of the transverse direction and the vertical direction, however, the invention may be applied to the reflective mirror having the reflective elements extending along a line inclined against the horizontal direction. Such modified form is particularly advantageous to a headlight device having an electric bulb with a shade being formed thereon to make a cut line in the light distribution pattern.

What is claimed is:

1. A headlight device comprising a reflective mirror having a reflective zone comprising principally a plurality of reflective elements of a generally vertically extending rectangular shape, and a light source arranged along an axis of irradiation which extends in the fore and aft direction of the reflective mirror, said reflective elements of said reflective zone being formed to have parabola-ellipse composite surfaces having the form of a parabola in vertical section and an ellipse in horizontal section, with the focus of the parabola being at a first focus of the ellipse.

2. A headlight device according to claim 1, wherein the arrangement and the configuration of the reflective elements are symmetrical with respect to the optical axis of the reflective mirror and in a transverse direction thereof.

3. A headlight device according to claim 1, wherein the reflective zone of the reflective mirror is divided into a plurality of reflective elements in a transverse direction thereof.

4. A headlight device according to claim 3, wherein the reflective zone of the reflective mirror is divided into a plurality of reflective elements in vertical and transverse directions thereof.

5. A headlight device according to claim 1, wherein the light source is an electric bulb provided at said first focus.

* * * * *